United States Patent [19]

Penebre

[11] Patent Number: 4,627,820

[45] Date of Patent: Dec. 9, 1986

[54] SWIM FIN

[76] Inventor: Larry M. Penebre, 138 Haseco Ave., Port Chester, N.Y. 10573

[21] Appl. No.: 745,911

[22] Filed: Jun. 18, 1985

[51] Int. Cl.[4] ..... A63B 31/08

[52] U.S. Cl. ..... 441/64

[58] Field of Search ..... 441/61–64; D21/239

[56] References Cited

U.S. PATENT DOCUMENTS

| | | | |
|---|---|---|---|
| 3,649,979 | 3/1972 | MacNiel | 441/64 |
| 3,913,158 | 10/1975 | Vilarrubis | 441/64 |
| 4,083,071 | 4/1978 | Forjot | 441/64 |

*Primary Examiner*—Trygve M. Blix
*Assistant Examiner*—Jesûs D. Sotelo
*Attorney, Agent, or Firm*—Perman & Green

[57] ABSTRACT

A swim fin is disclosed which comprises a foot portion, an essentially horizontal flipper and upper and lower shells coupling the foot portion and the flipper. Upper and lower channels are formed between the shells and the flipper for the flow of water therethrough. The channels initiate at water inlet apertures and terminate at water outlet apertures. The flipper extends outboardly of the channels and water outlet apertures to coact with water flowing from the outlet apertures for increased efficiency of the fin.

20 Claims, 9 Drawing Figures

5
30
26
28
28
16
7
60
58
42
62
20
52
18
46
48
54
44
38
40
14
5

30
16
60
58
7
72
68
64
62
18
76
74
14

SWIM FIN

BACKGROUND OF THE INVENTION

1. Field of the Invention

This invention relates to swimming apparatus and, in particular, to improved swim fins to be worn on the feet of a swimmer to increase his mobility and safety in the water.

2. Description of the Prior Art

In recent years there has been an increasing tendency of people to engage in water activities. Among the more popular of such water activities are swimming, snorkeling, scuba diving and the like. It has been found that improvements in apparatus for use during such water activities have enhanced the enjoyment and safety of people engaged in such activities.

Types of apparatus which are receiving ever increasing popularity are the flippers or swim fins. Swim fins are normally rubber or plastic devices secured to the feet of the swimmer in an effort to simulate the action of the horizontal tail fin of an aquatic mammal such as a dolphin or a whale, the webbed feet of a duck or the vertical tail fin of most fish. When a human swimmer participates in water activites with the aid of fins on his feet, his swimming speed is improved, his ability to tread water enhanced and his overall enjoyment of the activity greatly increased. Perhaps even more importantly, his safety is made greater when merely swimming or when participating in other aquatic events such as snorkeling or diving with self-contained underwater breathing apparatus, scuba gear.

A great many types of swim fins and related devices are on the market today. Prior patent disclosures illustrate the development of this technology to the present highly developed state that it enjoys today.

One early effort to provide for increased water safety and enjoyment is described in U.S. Pat. No. 1,841,904 to McGowan. According to that disclosure, an oval shaped device is strapped to each foot of a swimmer. Secured within the device, parallel with the sole of the foot, are a plurality of shutter plates in spaced orientation, one from another, in overlapping relationship. When a foot and associated device are moved downwardly the shutters close and the device offers resistance to further downward movement of the device, foot and swimmer. When the foot and device are moved upwardly, the shutters open in unison to easily permit the device and foot to be raised. As a result, treading water is made easier and less fatiguing, and the device thus promotes safety in the water along with enjoyment. To a lesser extent, it would appear that the McGowan device could also function for the purposes of the more modern swim fin.

The state of the art in swim fins has continued to develop through the years. Consider, for example, the fins disclosed in U.S. Pat. No. 3,055,025 to Ferraro and in U.S. Pat. No. 3,422,470 to Mares. Those disclosed devices resemble the modern fins of today in that they are of a one piece construction with an inboard end for receiving the foot of a wearer and a thin flexible outboard end or flipper to simulate the action of a webbed foot of a duck or a tail fin of an aquatic mammal. The disclosures of these patents discuss the benefits which accrue by the incorporation of an aperture or apertures in the thin flipper portion of the fin. But in one of these disclosures, that to Ferraro, an additional flap of material is used to close the apertures during one part of the kick cycle of the swimmer and to open the apertures on the other part of the kick cycle. According to the Mares disclosure, supplemental flaps are utilized in association with the apertures but are adapted to open the apertures during both portions of the kick cycle.

Subsequently, the development of swim fins included chambers along the axial lengths of the fins. Note, for example, U.S. Pat. No. 3,649,979 to MacNiel and U.S. Pat. No. 3,913,158 to Vilarrubus. According to these disclosures, the flat extended flipper portion of the fin includes two spaced parallel surfaces defining a chamber therebetween to pass water from an upper central portion of the flipper, the water inlet zone, to and through a water outlet zone at the outboard tip of the flipper directly into the water. In effect, the flipper material on opposite sides of the chamber acts as two flippers. According to the MacNiel disclosure, the cross section of the chamber decreases toward the tip of the flipper for improved efficiency. Conversely, Vilarrubus discloses increased efficiency by increasing the cross section of the chamber toward the tip of the flipper. Further, compartmentalizing of a chamber into laterally spaced parallel compartments is disclosed.

U.S. Pat. No. 4,083,071 to Forjot alleges an improvement over the structures of MacNiel and Vilarrubus by utilizing a single chamber along the length of the flipper of the fin but with water inlets both on the upper and lower faces of the fin. A flexible baffle to alternately open and close the upper and lower inlets determines whether water enters the chamber on either the upstroke or downstroke of the kick cycle of the swimmer.

Lastly, a relatively complex type of swim device is disclosed in U.S. Pat. No. 4,342,558 to Wilson. According to that disclosure, a pair of complex, cumbersome devices may be attached to the feet of a swimmer. The devices each include a rotatable hydrofoil operating with mechanisms to allegedly enhance a swimmers capabilities in the water while increasing his safety. This device could hardly be considered as a swim fin.

As illustrated by the great number of prior art patents, efforts are continuously being made in an attempt to solve the problem of designing a convenient, safe swim fin having particular utility in increasing the mobility, enjoyment, and safety of swimmers. None of these patents, however, discloses or suggests the present inventive combination of parts of the present inventive improved swim fin. The present invention achieves its purposes, objectives and advantages over the prior art structures through new, useful and unobvious elements with but a single part at a relatively low cost and through the utilization of only readily available materials and conventional components.

These objects and advantages should be construed as merely illustrative of some of the more prominent features and applications of the present invention. Many other beneficial results can be attained by applying the disclosed invention in a different manner or by modifying the invention within the scope of the disclosure. Accordingly, other objects and advantages as well as a fuller understanding of the invention may be had by referring to the summary of the invention and the detailed description describing the preferred embodiment of the invention in addition to the scope of the invention as defined by the claims taken in conjunction with the accompanying drawings.

SUMMARY OF THE INVENTION

The present invention is defined by the appended claims with the specific preferred embodiment shown in the attached drawings. For the purposes of summarizing the invention, the invention may be incorporated in the apparatus comprising a swim fin having a foot portion, an essentially horizontal flipper and shell means coupling the foot portion and the flipper. Channel means are defined between the shell means on one side and, on the other side, the flipper and the foot portion, the channel means are initiated at water inlet aperture means and terminate at water outlet aperture means and with the flipper extending across and outboardly of the channel means and the water outlet aperture means.

The shell means and the channel means are located above the flipper. The shell means and the channel means are located below the flipper. The shell means includes a top shell above the flipper and a bottom shell below the flipper and the channel means includes a top channel above the flipper and a bottom channel below the flipper. The swim fin further includes baffle means to alternately shut off and open the top channel and the bottom channel from the flow of water from the water inlet aperture means. The swim fin further includes cut out sections in the flipper located adjacent the outboard end of the flipper.

The invention may also be embodied in a swim fin comprising a foot portion located adjacent the inboard end and a flipper located adjacent the outboard end with a top shell coupling the foot portion and the flipper and defining a top channel beneath the top shell and above the flipper and the foot portion for the flow of water therethrough. The top channel initiates at an upper water inlet aperture located between the shell means and the foot portion at the inboard end of the top shell and terminates at an upper water outlet aperture located between the top shell and the flipper at the outboard end of the top shell.

A bottom shell couples the foot portion and the flipper and defines a bottom channel above the bottom shell and beneath the flipper and the foot portion for the flow of water therethrough. The bottom channel initiates at a lower water inlet aperture located between the shell means and the foot portion at the inboard end of the bottom shell and terminates at a lower water outlet aperture located between the bottom shell and the flipper at the outboard end of the bottom shell. The upper edge of the top shell is outboard of the lower edge of the top shell at the upper water inlet aperture, and the upper edge of the top shell is inboard of the lower edge of the top shell at the upper water outlet aperture. The upper edge of the bottom shell is inboard of the lower edge of the bottom shell adjacent the lower water inlet aperture, and the upper edge of the bottom shell is inboard of the lower edge of the bottom shell adjacent the lower water outlet aperture.

The swim fin further includes baffle means comprising an upper flap formed as part as the foot portion to close off the upper water inlet aperture from the flow of water upon the upstroke of a kick cycle of a swimmer. The baffle means also includes a lower flap formed as part as the foot portion to close off the lower water inlet aperture from the flow of water upon the downstroke of a kick cycle of a swimmer.

The upper edge of the top shell is outboard of the lower edge of the top shell at the upper water inlet aperture, and the upper edge of the top shell is inboard of the lower edge of the top shell at the upper water outlet aperture to allow the flow of water into the upper water inlet aperture and the upper water outlet aperture and out of the lower water outlet aperture during the downstroke cycle of a kick. The upper edge of the bottom shell is inboard of the lower edge of the bottom shell adjacent the lower water inlet aperture, and the upper edge of the bottom shell is inboard of the lower edge of the bottom shell adjacent the lower water outlet to allow the flow of water into the lower water inlet aperture and out of the upper water outlet aperture during the upstroke cycle of a kick. The swim fin further includes a flipper secured to said top shell and said bottom shell and extending outboardly of the water outlet apertures.

The invention may also be considered as being embodied in a swim fin comprising a foot portion located at the inboard end of the fin and a flipper located at the outboard end of the fin, a top shell coupling the foot portion and the flipper and defining a top channel beneath the top shell and above the flipper and the foot portion. The top channel initiates at an upper water inlet aperture located between the top shell and the foot portion at the inboard end of the top shell, and the top channel terminates at an upper water outlet aperture located between the top shell and the flipper at the outboard end of the top shell. A bottom shell couples the foot portion and the flipper and defines a bottom channel above the bottom shell and beneath the flipper and the foot portion. The bottom channel initiates at a lower water inlet aperture located between the bottom shell and the foot portion at the inboard end of the bottom shell and terminates at a lower water outlet aperture located between the bottom shell and the flipper at the outboard end of the bottom shell. The flipper extends outboard of the upper and lower water outlet apertures.

Further included is a baffle means to alternately shut off the upper water inlet aperture and the lower water inlet aperture from the entrance of water. The upper edge of the top shell is outboard of the lower edge of the top shell at the upper water inlet aperture, and the upper edge of the top shell is inboard of the lower edge of the top shell at the upper water outlet aperture to allow the flow of water into the upper water inlet aperture and the upper water outlet aperture and out of the lower water outlet aperture against the lower surface of the flipper during the downstroke cycle of a kick. The upper edge of the bottom shell is inboard of the lower edge of the bottom shell adjacent the lower water inlet aperture, and the upper edge of the bottom shell is inboard of the lower edge of the bottom shell adjacent the lower water outlet to allow the flow of water into the lower water inlet aperture and out of the upper water outlet aperture against the upper surface of the flipper during the upstroke cycle of a kick.

The baffle means comprises an upper flap formed as part of the foot portion to open the lower water inlet aperture for the flow of water upon the upstroke of a kick cycle of a swimmer. The baffle means also includes a lower flap formed as part of the foot portion to open the upper water inlet aperture for the flow of water upon the downstroke of a kick cycle of a swimmer.

The swim fin further includes a vertical membrane to separate the upper channel and the lower channel into two essentially equally shaped smaller longitudinal channels. The membrane extends outboardly to the water outlet apertures and extends inboardly to a location outboardly of the central part of the foot portion. The foot portion is fabricated of a flexible, waterproof material and the remainder of the swim fin is fabricated of a flexible, waterproof material but of a material less flexible than the foot portion.

The swim fin further includes a foot strap and the foot portion is provided with protuberances for the adjustable receipt of the foot strap for receiving and supporting a foot of any of a plurality of sizes. The swim fin further includes a plurality of cut outs extending through the flipper, generally symmetrically oriented on both sides of the longitudinal centerline of the flipper. The swim fin further includes thickened lengths of material along the longitudinal centerline of the top shell and the bottom shell to constitute stabilizer bars to reduce the flexibility of the top shell and the bottom shell.

The foregoing has outlined rather broadly the more pertinent and important features of the present invention in order that the detailed description of the invention that follows may be better understood whereby the present contribution to the art can be more fully appreciated. Additional features of the invention will be described hereinafter which form the subject of the claims of the present invention. It should be appreciated by those skilled in the art that the conception and specific embodiment disclosed herein may be readily utilized as a basis for modifying or designing other structures and the specific embodiment disclosed herein may be readily utilized as a basis for modifying, designing or carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the nature, objects and advantages of the present invention, reference should be had to the following detailed description taken in conjunction with the accompanying drawings in which.

Similar reference numerals refer to similar parts throughout the several drawings.

DETAILED DESCRIPTION OF THE INVENTION

Figure 1:
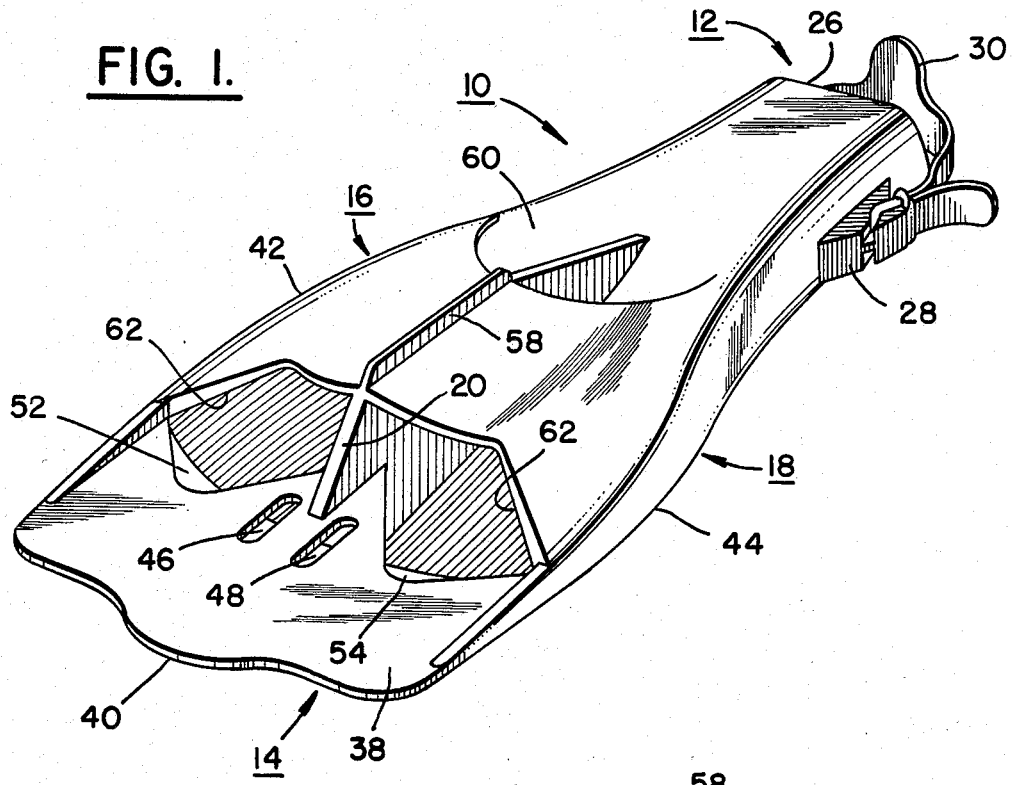
FIG. 1 is a perspective illustration of the preferred embodiment of the swim fin constructed in accordance with the principles of the present invention viewing the device from the outboard end.
Figure 6:
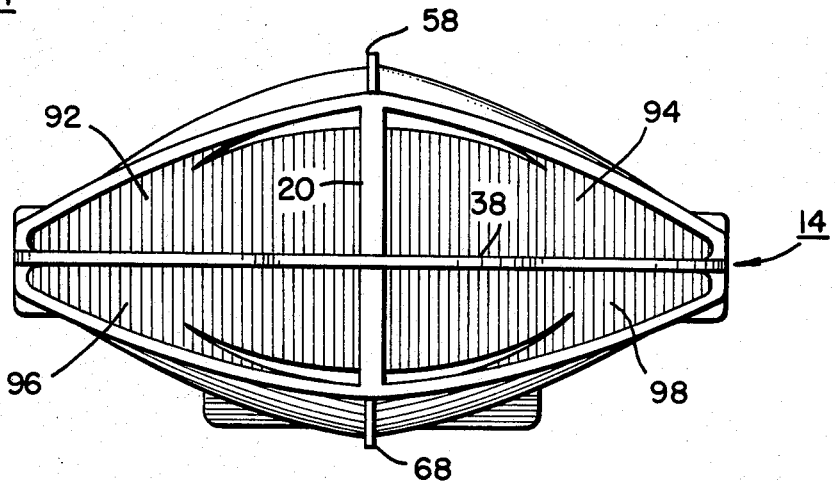
FIG. 6 is a front view of the swim fin looking at the swim fin from the tip or outboard end.
Figure 7:
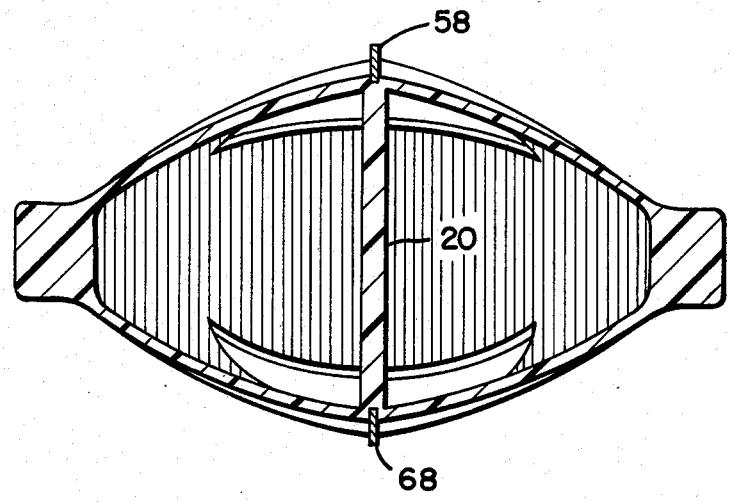
FIG. 7 is a sectional view taken along line 7—7 of FIG. 2.
Figure 2:
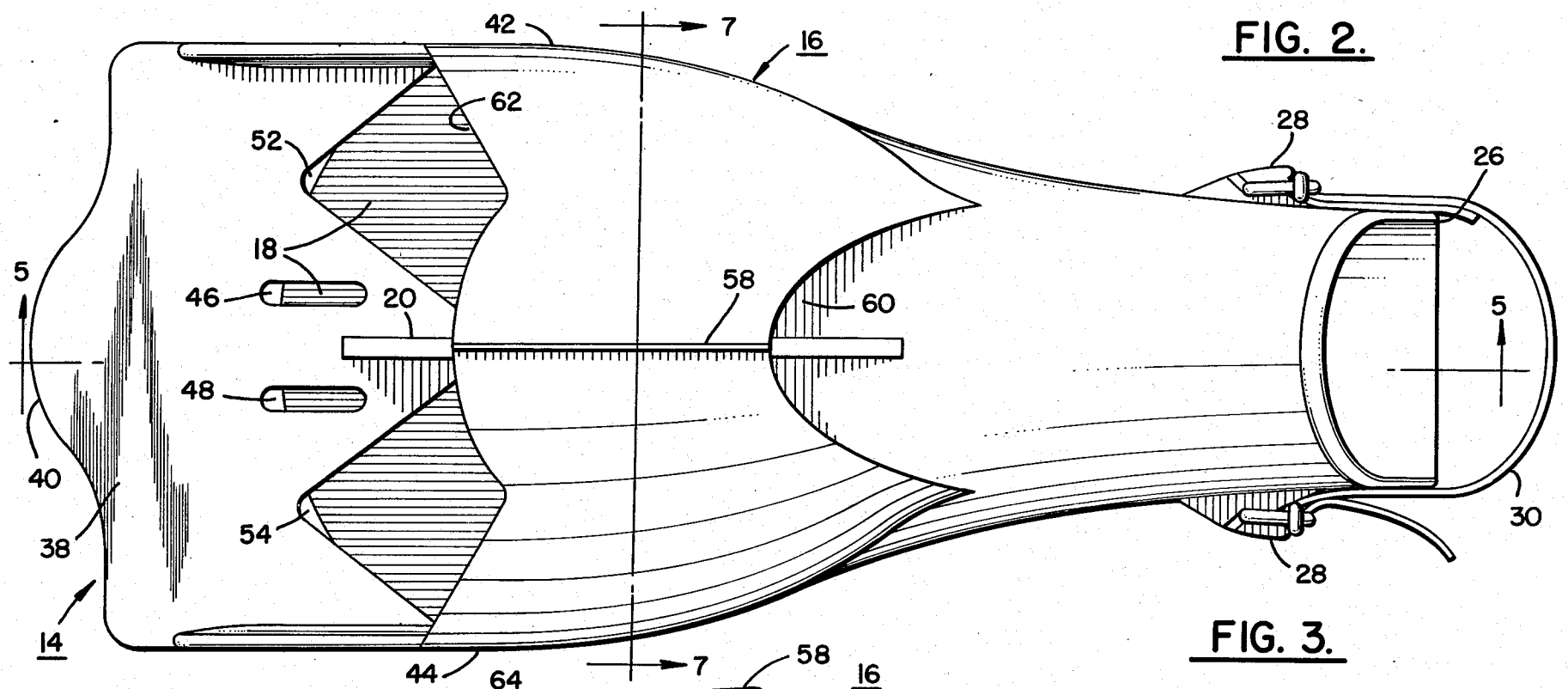
FIG. 2 is a top plan view of the swim fin shown in FIGS. 1.
Figure 3:
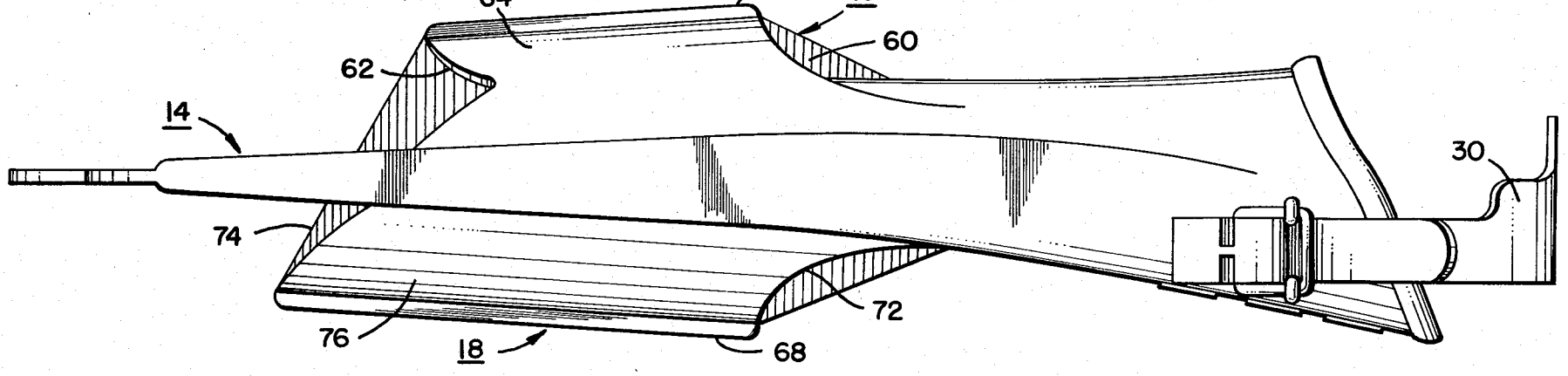
FIG. 3 is a side elevational view of the swim fin.
Figure 4:
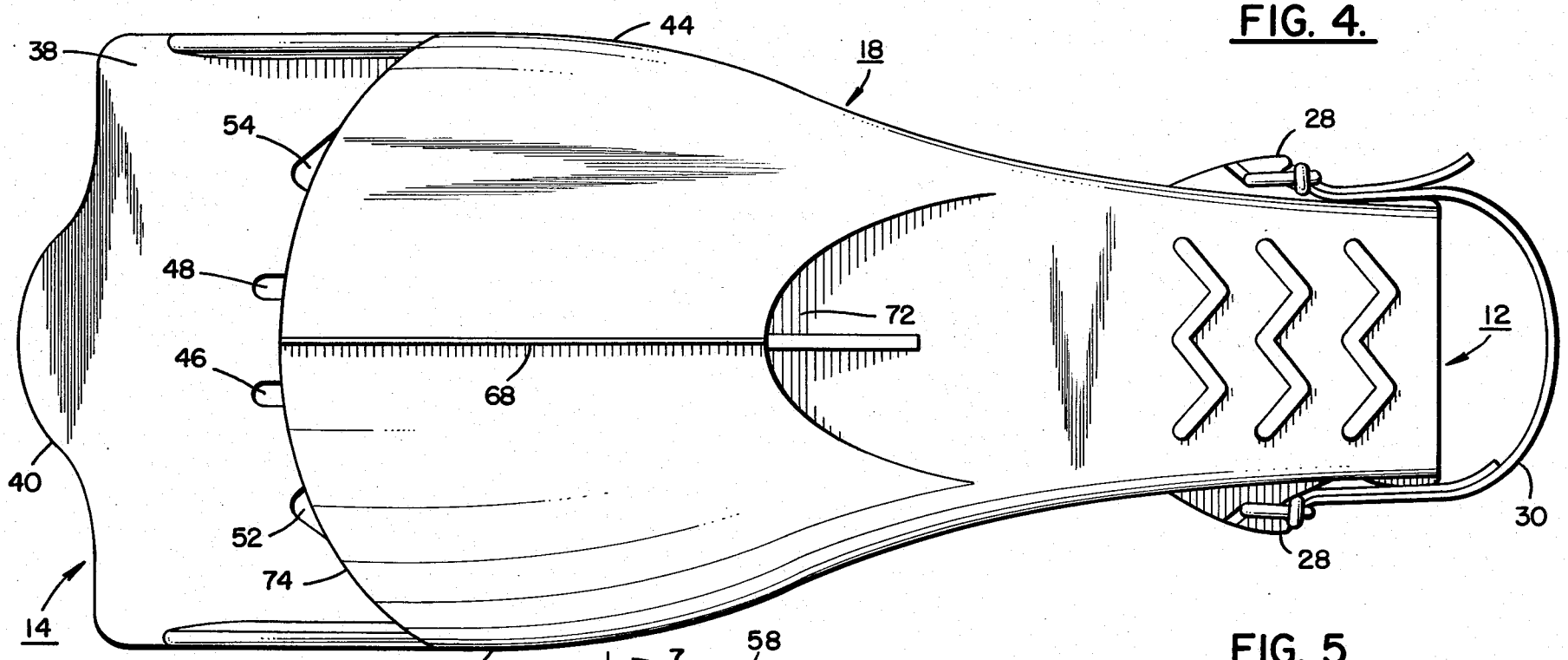
FIG. 4 is a bottom plan view of the swim fin.
Figure 5:
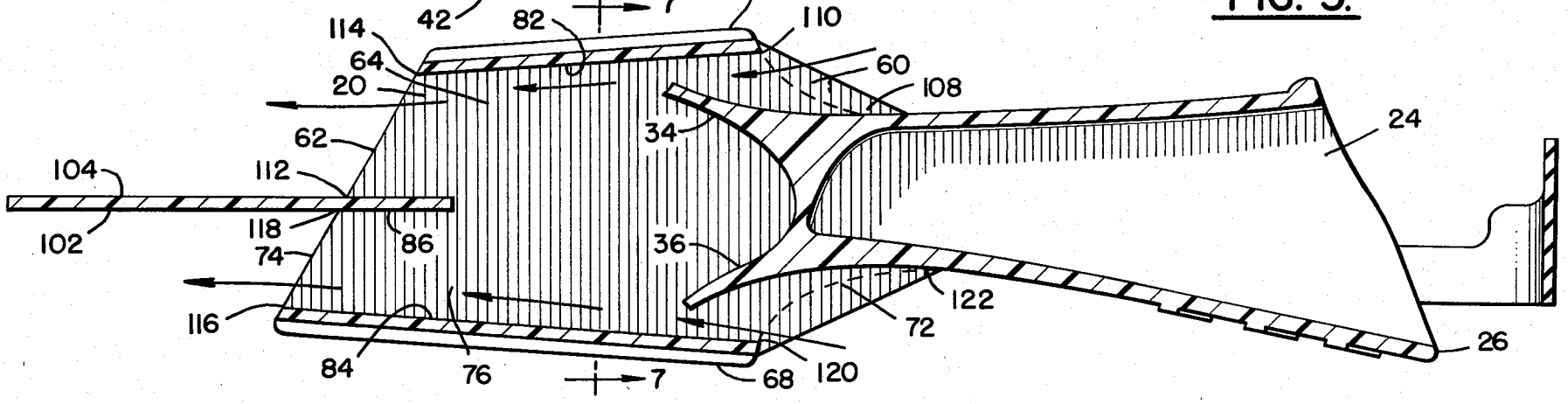
FIG. 5 is a sectional view of the swim fin taken along line 5—5 of FIG. 2.

Shown in the various drawings is a swim fin 10 constructed in accordance with the principles of the present invention. The fin includes a relatively conventional foot portion 12 and web or flipper 14. The fin also includes an upper or top shell 16, a lower or bottom shell 18, and a vertical membrane 20.

As used herein, the term "outboard" is intended to mean the tip end of the fin most remote from the foot of a user of the fin. "Outboard" may also mean in a direction toward the outboard end. Further, the term "inboard" is intended to mean that end of the fin adjacent the foot of the wearer or most remote from the tip end. "Inboard" could also mean in a direction toward the inboard end. Additionally, the term "instep", "upper" or "top" is intended to mean that face, or toward that face, of the swim fin which is above the remainder of the fin when the wearer of the fin is standing on the ground. The term "sole", "lower" or "bottom" is intended to mean that face, or toward that face, of the swim fin remote from the instep, upper or top end when the wearer of the fin is standing on the ground. Note is taken that the top of the fin is beneath the bottom of the fin, and the bottom of the fin is above the top of the fin, when a swimmer is employing the fin during the swimming of a front or crawl stroke.

For the sake of convenience, the swim fin of the present invention will be described herein in terms of a single fin. It should be understood, however, that two fins of the same, or substantially the same, design would be used during normal swimming or other water activity.

The fin is constructed to be detachably secured to the foot of a user through a recessed section 24 of the foot portion 12 at the inboard end 26 of the fin 10. The recessed section has an opening of sufficient depth and breadth so as to receive and support the toes and most of the foot of the user. Protuberances 28 are provided externally on both sides of the foot portion for the adjustable receipt of a strap 30 adapted to be received around the back of the foot of a user. The strap and protuberances are of such sizes and configurations as to allow adjustment to accommodate varying foot sizes of users.

Extending outboardly of the recessed section, and formed as part of the foot portion of the fin, are a pair of spaced, essentially horizontally disposed baffles 34 and 36. The purpose of the baffles will be discussed hereinafter.

The next portion of the fin is the relatively conventional horizontally disposed web or flipper 38. The flipper is of decreasing thickness as it is viewed outboardly and is provided with an outboardly projecting tip 40 of yet further reduced thickness. Transversely, the greatest thickness of the flipper is along its longitudinal centerline as it tapers outwardly toward each edge 42 and 44. The flipper functions in a manner similar to the feet of ducks or the tail fins of aquatic mammals to propel a swimmer through the water or during the treading of water by the normal up and down kick cycle of the feet of a swimmer. The flipper thus may be considered as constituting extensions of the feet of a swimmer for extended swimming efficiency and safety.

It has been found that the efficiency of the fin is increased through the use of cut out sections 46 and 48 adjacent the outboard end of the flipper. In the particular embodiment, a pair of essentially symmetric oval cutouts are formed adjacent the tip on opposite sides of the longitudinal centerline of the flipper and fin with their major axes parallel with the centerline. Additionally, a pair of essentially symmetric spaced rectangular cut outs 52 and 54 are provided inboard of the oval cutouts on opposite sides of the centerline for maximum efficiency. Without such cutouts to allow the flow of water therethrough, the forces of the enlarged fin would create detrimental motion restricting forces on the fin thereby diminishing the efficiency of the fin.

The flipper is coupled with the foot portion through an upper or top shell 16 and a lower or bottom shell 18. The top shell is formed of a piece of material having a strengthened centerline constituting an upper stabilizer bar 58. The material of the top shell extends generally horizontally from both sides of the top stabilizer bar 58 and then generally downwardly toward the edges 42 and 44 of the fin. At their edges, the top or upper shell couples with the edges of the flipper at their outboard ends. At their inboard end, the edges 42 and 44 of the top shell 16 couple with the foot portion 12.

A space is provided at the inboard end of the top shell to define a water inlet aperture 60 between the top shell and the foot portion. The outboard end of the top shell defines a water outlet aperture 62 between the top shell and the flipper. The space between the flipper and top shell constitutes the upper or top channel 64 for the flow of water therethrough during operation and use of the fin.

A lower or bottom shell 18 is also provided with a strengthened longitudinal centerline constituting a bottom or lower stabilizing bar 68 parallel with the centerline of the fin. Side walls extend from the stabilizer bar generally outwardly then generally upwardly to the edges 42 and 44 of the flipper at its forward end and with the side walls coupling with the foot portion at the inboard end. A lower or bottom water inlet aperture 72 is thus formed on the lower or bottom of the fin between the side walls of the bottom shell and the foot portion, and a lower or bottom water outlet aperture 74 is formed between the bottom shell and the flipper at the outboard end of the bottom shell. A lower or bottom channel 76 is thus formed between the water inlet aperture and the water outlet aperture.

The last structural element of the fin is a vertical membrane 20 secured at its top edge 82 to the top stabilizer bar 58 and, at its bottom edge 84, to the bottom stabilizer bar 68. The central extent 86 of the vertical membrane at the outboard end is coupled to the centerline of the flipper. The vertical membrane functions to divide both the upper channel and lower channel into a left section, 92 and 96, and a right section, 94 and 98, for each fin. The vertical membrane 20 also provides an extra degree of structural integrity and rigidity to the fin 10.

Figure 8:
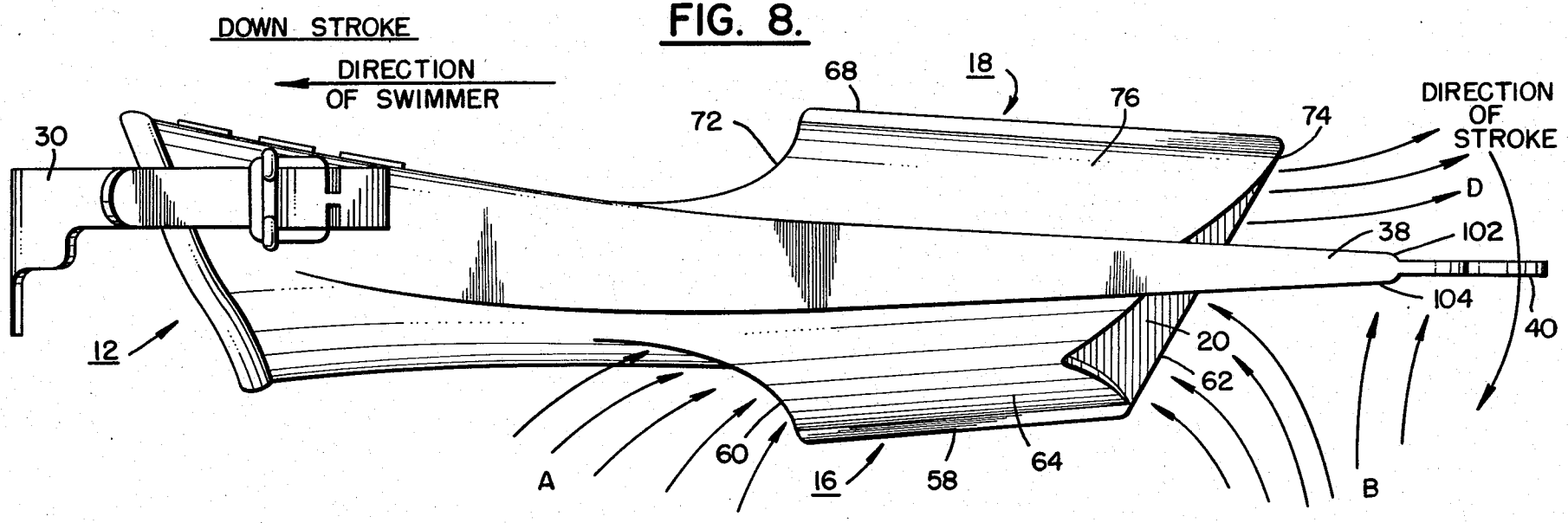
FIG. 8 is a side elevational view similar to that shown in FIG. 3 but illustrating the flow of water through the device during the down stroke of the kick cycle of the swimmer.

The baffles 34 and 36 as described earlier, when in the rest position, would allow the flow of water from both the upper inlet aperture and lower inlet aperture into and through the upper channel and lower channel and out the upper and lower outlet apertures. In use, however, the power kick of a swimmer is in the downward direction of the large arrow of FIG. 8. In that figure, note is taken that due to the forces and directions of the water, as illustrated by the small arrows, the lower baffle 36 will close the lower water inlet aperture 72 and the upper baffle 34 will open the upper water inlet aperture 60 whereby water will be forced into the upper inlet aperture 60 as well as the upper outlet aperture 62 and proceed through both sections 92 and 94 of the upper channel 64 and out the lower outlet aperture 74. The action of the water jetting out of the outlet with reduced dispersion, deflecting off of the lower face 102 of the outboard extension of the flipper 14 will provide a driving action to the swimmer and propel him through the water more efficiently than in any prior art structure. The angles of the upper or top shell assist in allowing the maximum amount of water through the upper channel, the lower channel and out of the lower water outlet aperture. This is due to the upper edge 110 of the water inlet aperture 60 being outboard of the lower edge 108 and because of the upper edge 114 of the water outlet aperture 62 being inboard of the lower edge 112.

Figure 9:
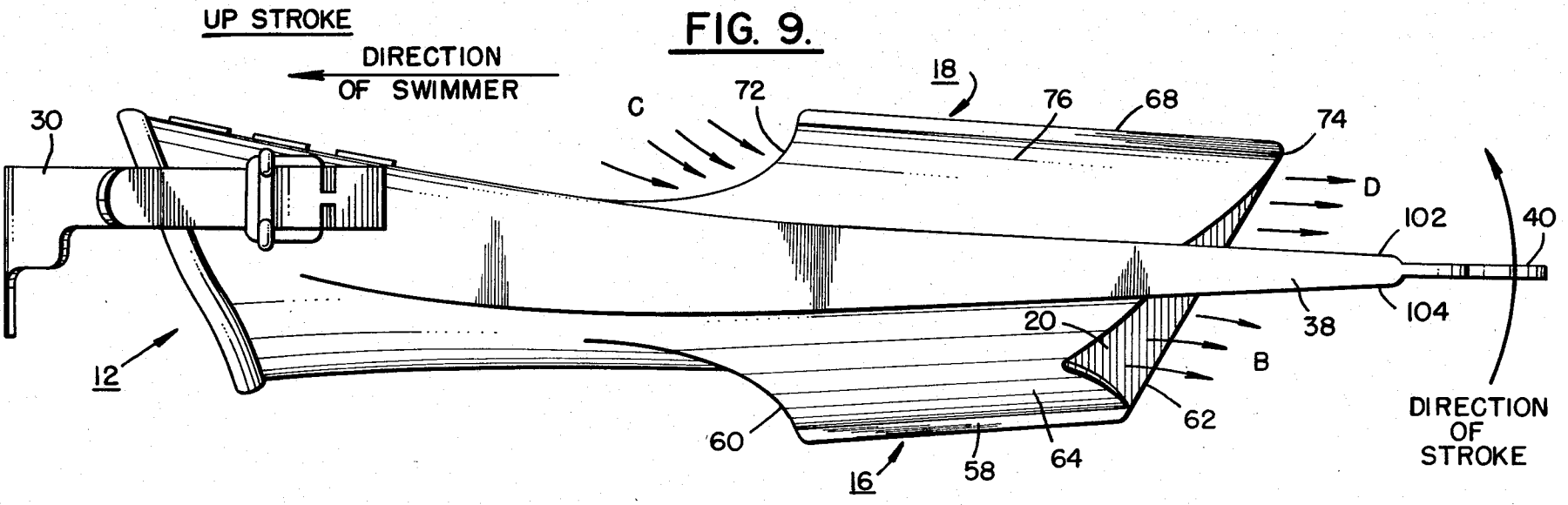
FIG. 9 is a view similar to FIG. 8 but illustrating the flows of water during the up stroke of the kick cycle of the swimmer.

On the return or up stroke, as illustrated by the larger arrow of FIG. 9, lower baffle 36 will open and water will enter the lower water inlet aperture 72 and flow with force in the direction of the smaller arrows. The smaller arrows also indicate the forces of the water upon the fin. The upper baffle 34 will close to preclude water from entering through the upper water inlet aperture 60. The entered water will flow through the upper and lower chambers 64 and 76 and be expelled from both the upper and lower water outlet apertures 62 and 74 and across the upper and lower faces faces 102 and 104 of the flipper 14 for increased propulsive forces to the swimmer. No water enters from outside the fin through the lower water outlet aperture 74 since the lower edge 116 of the lower shell 18 is outboard of the upper edge 118. Water may flow into the lower water inlet aperture 72 since the lower edge 120 of the aperture is outboard of the upper edge 122.

In other words, the configuration of the bottom shell 18, having its stabilizer bar 68 extending outboardly of the upper edge 118 of the lower water outlet aperture 74, will preclude water from entering the bottom shell on the return or upward kick. In comparison with this, the shorter upper stabilizer bar 58 will expose both the upper inlet aperture 60 and upper outlet aperture 62 so that both receive water during the forward or downward kick cycle. As a result the return kick provides a jet-like action to the swimmer, but the forward cycle of the kick stroke, the more powerful of the kick strokes, is provided with a doubling of the propulsive forces for maximizing the overall efficiency of the system.

While various materials and manufacturing techniques could be utilized, it is preferred to mold the foot portion of a relatively soft rubber or plastic material, impervious to natural and salt water, but flexible enough to conform to the foot of a user and bend during operation and use to open and close the water inlet and outlet apertures. Silicone rubber has been found to be most desirable for these purposes. The upper and lower shells as well as the flipper and vertical membrane are preferably molded of a waterproof, flexible material but somewhat more rigid than that of the silicone rubber. A plastic material such as one containing graphite has been found to be an optimum material. The graphite is used in the plastic so that the plastic can be made quite thin and flexible yet still maintain an adequate degree of strength. Molding of the foot portion separate from the remainder of the fin, followed by their bonding together as through an adhesive or vulcanization has been found appropriate for coupling the various pieces together to form the final fin product.

In use, a swimmer would place a fin on each foot by inserting his toes and the forward portion of each foot in a recess of each foot portion. He would then place the strap of each fin around the back of each foot and adjust the strap for a proper fit. When swimming on his stomach and doing the front crawl, the face of the fin, that had been on top while standing, now becomes positioned beneath the remainder of the fin away from the surface of the water. The swimmer would then employ the scissors kick wherein each leg and foot is kicked upwardly and then downwardly in alternating, continuous succession for providing a forward propulsive force to the swimmer.

The flexibility of each fin would cause the fin to bend in one direction toward the surface of the water during the downward stroke of the leg and fin and then bend in a reverse direction away from the surface of the water during the upward stroke. Compare the showings in FIGS. 8 and 9.

The enlargement of the feet of the swimmer as effectively caused by the use of the fins, taken in conjuction with the flows of water as described above, provide for the increased swimming efficiency and safety of a user of the swim fins. Such benefits also accrue to a swimmer using any other type of stroke, whether the swimmer is on his front or on his back, or even if he is only treading water.

The present disclosure includes that information contained in the appended claims as well as that in the foregoing description. Although the invention has been described in its preferred former embodiment, with a certain degree of particularity, it is understood that the present disclosure of the preferred form has been made only by way of example and that numerous changes of the details of construction, fabrication and use, including the combination and arrangement of parts and steps, may be resorted to without departing from the spirit and scope of the invention.

I claim:

1. A swim fin comprising a foot portion, an essentially horizontal flipper and shell means coupling said foot portion and said flipper and defining channel means between said shell means on one side and, on the other side, said flipper and said foot portion, said channel means initiating at water inlet aperture means and terminating at water outlet aperture means and with said flipper extending across and outboardly of said channel means and said water outlet aperture means.

2. The swim fin as set forth in claim 1 wherein said shell means and said channel means are located above said flipper.

3. The swim fin as set forth in claim 1 wherein said shell means and said channel means are located below said flipper.

4. The swim fin as set forth in claim 1 wherein said shell means includes a top shell above said flipper and a bottom shell below said flipper and said channel means includes a top channel above said flipper and a bottom channel below said flipper.

5. The swim fin as set forth in claim 4 and further including baffle means to alternately shut off and open said top channel and said bottom channel from the flow of water from said water inlet aperture means.

6. The swim fin as set forth in claim 1 and further including cut out sections in said flipper located adjacent the outboard end of said flipper.

7. A swim fin comprising a foot portion located adjacent the inboard end and a flipper located adjacent the outboard end, a top shell coupling said foot portion and said flipper and defining a top channel beneath said top shell and above said flipper and said foot portion for the flow of water therethrough, said top channel initiating at an upper water inlet aperture located between said shell means and said foot portion at the inboard end of said top shell, said top channel terminating at an upper water outlet aperture located between said top shell and said flipper at the ouboard end of said top shell, and a bottom shell coupling said foot portion and said flipper and defining a bottom channel above said bottom shell and beneath said flipper and said foot portion for the flow of water therethrough, said bottom channel initiating at a lower water inlet aperture located between said shell means and said foot portion at the inboard end of said bottom shell, said bottom channel terminating at a lower water outlet aperture located between said bottom shell and said flipper at the outboard end of said bottom shell.

8. The swim fin as set forth in claim 7 wherein the upper edge of said top shell is outboard of the lower edge of said top shell at said upper water inlet aperture, and the upper edge of said top shell is inboard of the lower edge of said top shell at said upper water outlet aperture aperture.

9. The swim fin as set forth in claim 7 wherein the upper edge of said bottom shell is inboard of the lower edge of said bottom shell adjacent said lower water inlet aperture, and the upper edge of said bottom shell is inboard of the lower edge of said bottom shell adjacent said lower water outlet.

10. The swim fin as set forth in claim 7 and further including baffle means comprising an upper flap formed as part of said foot portion to close off said upper water inlet aperture from the flow of water upon the upstroke of a kick cycle of a swimmer, said baffle means also including a lower flap formed as part of said foot portion to close off said lower water inlet aperture from the flow of water upon the downstroke of a kick cycle of a swimmer.

11. The swim fin as set forth in claim 7 wherein the upper edge of said top shell is outboard of the lower edge of said top shell at said upper water inlet aperture, and the upper edge of said top shell is inboard of the lower edge of said top shell at said upper water outlet aperture to allow the flow of water into said upper water inlet aperture and said upper water outlet aperture and out of said lower water outlet aperture during the downstroke cycle of a kick, and the upper edge of said bottom shell is inboard of the lower edge of said bottom shell adjacent said lower water inlet aperture, and the upper edge of said bottom shell is inboard of the lower edge of said bottom shell adjacent said lower water outlet to allow the flow of water into said lower water inlet aperture and out of said upper water outlet aperture during the upstroke cycle of a kick.

12. The swim fin as set forth in claim 11 and further including a flipper secured to said top shell and said bottom shell and extending outboardly of said water outlet apertures.

13. A swim fin comprising a foot portion located at the inboard end of the fin and a flipper located at the outboard end of the fin, a top shell coupling said foot portion and said flipper and defining a top channel beneath said top shell and above said flipper and said foot portion, said top channel initiating at an upper water inlet aperture located between said top shell and said foot portion at the inboard end of said top shell, said top channel terminating at an upper water outlet aperture located between said top shell and said flipper at the outboard end of said top shell, and a bottom shell coupling said foot portion and said flipper and defining a bottom channel above said bottom shell and beneath said flipper and said foot portion, said bottom channel initiating at a lower water inlet aperture located between said bottom shell and said foot portion at the inboard end of said bottom shell, said bottom channel terminating at a lower water outlet aperture located between said bottom shell and said flipper at the outboard end of said bottom shell and with said flipper extending outboard of said upper and lower water outlet apertures and further including baffle means to alternately shut off said upper water inlet aperture and said lower water inlet aperture from the entrance of water.

14. The swim fin as set forth in claim 13 wherein the upper edge of said top shell is outboard of the lower edge of said top shell at said upper water inlet aperture, and the upper edge of said top shell is inboard of the lower edge of said top shell at said upper water outlet aperture to allow the flow of water into said upper water inlet aperture and said upper water outlet aperture and out of said lower water outlet aperture against the lower surface of the flipper during the downstroke cycle of a kick, and the upper edge of said bottom shell is inboard of the lower edge of said bottom shell adjacent said lower water inlet aperture, and the upper edge of said bottom shell is inboard of the lower edge of said bottom shell adjacent said lower water outlet to allow the flow of water into said lower water inlet aperture and out of said upper water outlet aperture against the upper surface of the flipper during the upstroke cycle of a kick.

15. The swim fin as set forth in claim 14 wherein said baffle means comprises an upper flap formed as part as said foot portion to open said upper water inlet aperture for the flow of water upon the downstroke of a kick cycle of a swimmer, said baffle means also including a lower flap formed as part as said foot portion to open said lower water inlet aperture for the flow of water upon the upstroke of a kick cycle of a swimmer.

16. The swim fin as set forth in claim 13 and further including a vertical membrane to separate said upper channel and said lower channel into two essentially equally shaped smaller longitudinal channels, said membrane extending outboardly to said water outlet apertures and extending inboardly to a location outboardly of the central part of said foot portion.

17. The swim fin as set forth in claim 13 wherein said foot portion is fabricated of a flexible, waterproof material and the remainder of said swim fin is fabricated of a flexible, waterproof material but of a material less flexible than said foot portion.

18. The swim fin as set forth in claim 13 and further including a foot strap and wherein said foot portion is provided with protuberances for the adjustable receipt of said foot strap for receiving and supporting a foot of any of a plurality of sizes.

19. The swim fin as set forth an claim 13 and further including a plurality of cut outs extending through said flipper, generally symmetrically oriented on both sides of the longitudinal centerline of said flipper.

20. The swim fin as set forth in claim 13 and further including thickened lengths of material along the longitudinal centerline of said top shell and said bottom shell to constitute stabilizer bars to reduce the flexibility of said top shell and said bottom shell.

* * * * *